United States Patent [19]

Hays et al.

[11] Patent Number: 4,802,538

[45] Date of Patent: Feb. 7, 1989

[54] PILING HAMMER

[76] Inventors: Brian Hays, 17 Falstone Crescent, Ashington, Northumberland; Clive Taylor, 16 All Saints Road, Shildon, County Durham, both of England

[21] Appl. No.: 832,102

[22] Filed: Feb. 20, 1986

[51] Int. Cl.[4] ..... B21J 7/06

[52] U.S. Cl. ..... 173/1; 173/2; 173/115; 173/139

[58] Field of Search ..... 173/1, 2, 115, 121, 173/139, DIG. 4, 19, 20, 82, 83; 269/23; 254/93 R; 405/228, 232

[56] References Cited

U.S. PATENT DOCUMENTS

| | | | |
|---|---|---|---|
| 3,721,095 | 3/1973 | Chelminski | 173/1 |
| 3,744,578 | 7/1973 | Lisenby | 173/83 |
| 3,797,585 | 3/1974 | Ludvigson | 173/1 |
| 4,109,621 | 8/1978 | Hashimoto et al. | 173/115 |
| 4,580,640 | 4/1986 | Boldt | 173/82 X |
| 4,660,655 | 4/1987 | Wilner | 173/82 |

*Primary Examiner*—E. R. Kazenske
*Assistant Examiner*—James L. Wolfe
*Attorney, Agent, or Firm*—Rodman & Rodman

[57] ABSTRACT

A hammer for driving a pile into the ground has a cylindrical barrel and an anvil sealed to an end of the barrel, a hammer piston mounted for reciprocation within the barrel towards and away from the anvil, hydraulic cylinders to lift the hammer piston away from the anvil, and a switch, responsive to an increase in fluid pressure in the space between the hammer piston and the anvil, to activate the lift means. The invention includes a method of driving a pile into the ground, in which the pile-driving impact is transmitted to the pile via a confined quantity of hydraulic fluid and the weight by which the impact is applied is lifted, to a position from which to apply a further impact, in response to an increase in pressure in the hydraulic fluid.

8 Claims, 1 Drawing Sheet

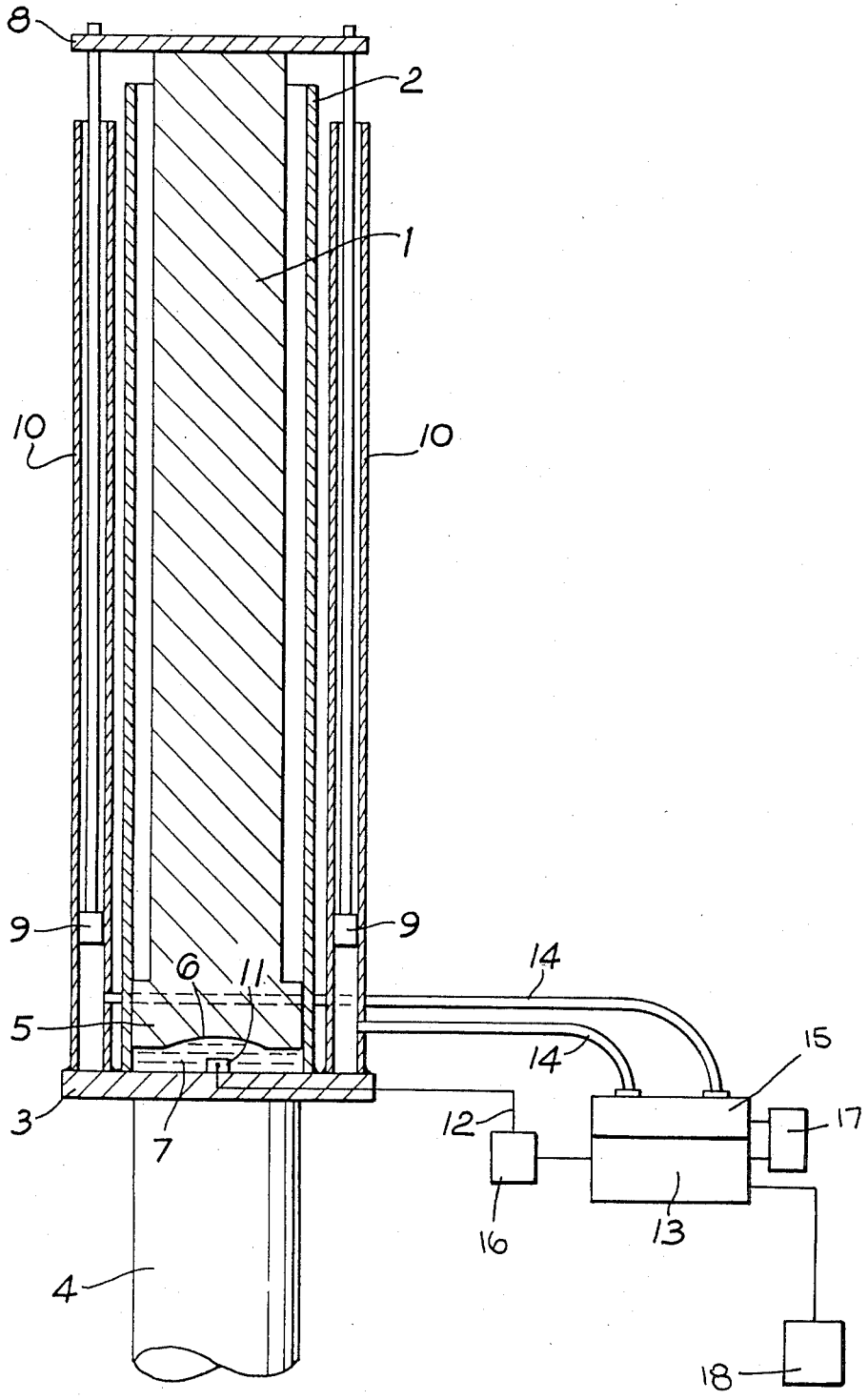
8
2
1
10
10
9
9
6
11
14
5
14
15
3
7
12
17
16
13
4
18

PILING HAMMER

BACKGROUND OF THE INVENTION

Field of The Invention

The present invention is an improved piling hammer, such as may be used for driving load-bearing piles into the ground.

Conventionally, piling hammers are fairly crude devices, sometimes consisting of little more than a heavy weight which is lifted by a crane and dropped repeatedly upon the upper end of a pile or upon an anvil supported upon the upper end of a pile. A cushion may be interposed between the anvil and the hammer in order to modify the stresses created in the pile as a result of the impact of the hammer. Thus a block of wood has been used for this latter purpose and more recently it has been proposed to interpose a cushion of hydraulic liquid between the hammer and an anvil. However the basic method of operation, that is lifting and dropping the hammer using a crane or similar lifting device, has continued to be used unchanged and it is therefore invariably necessary to make suitable lifting equipment available on site.

OBJECTS AND SUMMARY OF THE INVENTION

It is an object of the present invention to provide an improved piling hammer, which may be independent of such usual lifting equipment and may therefore be more readily brought into use and more readily transferred from one site of operation to another.

The piling hammer according to the present invention comprises a cylindrical barrel, an anvil sealingly secured to an end of the cylindrical barrel, a piston mounted for reciprocation within the cylindrical barrel between a first position in which the piston is further from said anvil and a second position in which the piston is nearer to said anvil, lift means to lift the piston from said second position towards said first position, and fluid-pressure-responsive switch means operable in response to an increase in pressure in any hydraulic fluid between said piston and said anvil to activate said lift means.

The invention also includes a method of driving a pile into the ground, comprising disposing said pile uprightly upon or at least partly within the ground, confining a quantity of a hydraulic fluid in a chamber which is in direct or indirect impact-transmitting contact with the upper end of said pile, striking the upper surface of the hydraulic fluid by allowing a substantial weight to drop thereon, detecting a resulting increase in the pressure of said hydraulic fluid and lifting said weight in response to such pressure increase.

As indicated, the piling hammer and the pile-driving method according to the present invention require that the impact upon the upper end of the pile should be transmitted via a body of hydraulic fluid. The fluid, which may be disposed in a chamber defined by the cylindrical barrel between the piston and the anvil, acts as a cushion, in known manner, to modify the stresses arising from the impact of the piston and also has the important beneficial effect of significantly reducing the noise which would otherwise occur. According to the [illegible]ent invention, the pressure of the hydraulic fluid is [illegible]d in such a way that an increase in fluid pres[illegible] occurs on impact of the piston is detected and the piston is lifted to its start position in response to the detection of a pressure increase.

Because the lifting of the piston is a direct response to the detection of a hammer blow, it becomes possible to initiate a fresh cycle of lifting and dropping automatically. Thus the operation is less dependent upon the skills, or even the presence, of an operator to control the lifting of the piston and its subsequent release. A very important further advantage is that, by carrying out the operation automatically, it is made possible to begin each cycle much sooner after the hammer impact and thereby to include more cycles, and therefore more effective percussive blows on the pile, in a given space of time. Thus more efficient use of equipment time may be achieved.

The pressure-responsive switch by means of which the hammer impact is detected may be a hydraulic switch but it is particularly preferred to use an electric switch. That is, the signal from the switch indicating that the pressure increase arising from a hammer impact has occurred is preferably an electrical signal. Electrical delay means may advantageously be interposed in the circuit between the electric switch and the lift means, to ensure that the piston has completed its useful work associated with the impact before the lift means lifts the piston out of contact with the fluid cushion.

Any form of lift means capable of lifting the piston at a desired rate may be used in the piling hammer according to the present invention. Thus the piston may be lifted mechanically or pneumatically, with the operation being improved in the latter case by the provision of an air pressure accumulator. However, it is strongly preferred to use a hydraulic lift means, for example one or more pistons and associated hydraulic cylinders directly mechanically linked to the hammer piston and operating substantially in parallel alignment with it. When the hammer piston is at its desired uppermost point, the hydraulic fluid pressure in the cylinder may be quickly released, for example by the opening, preferably automatically, of a pressure-release valve, so that the piston may drop on to the fluid in the barrel and thereby strike the pile a further blow.

Preferably the height to which the hammer piston is lifted is variable, in order to allow the impact upon the pile to be varied to suit the ambient conditions. In a particularly preferred form of the present invention, the length of time for which the lift means is operated is variable, in order thereby to vary the height to which the piston is lifted.

DESCRIPTION OF THE DRAWING

The invention will now be further described by reference to the accompanying drawing, which illustrates, by way of example, one preferred embodiment of piling hammer according to the present invention. The illustration is a partly schematic vertical sectional view.

DESCRIPTION OF THE PREFERRED EMBODIMENT

The illustrated hammer comprises a piston 1 mounted for reciprocal linear movement within a cylindrical barrel 2 welded to a base 3. The piston 1 typically weighs between one and six tons but other sizes of piston are equally suitable, depending upon the intended piling duty. The whole assembly is hydraulically clamped or locked upon the upper end of a pile 4.

The lower end of the piston 1 is enlarged radially to form a piston head 5 having a concave recess 6 in its lower face. The piston head 5 is a close sliding fit within the barrel 2. Confined in the chamber defined by the barrel 2 between the piston head 5 and the base 3 is a quantity of a hydraulic oil 7.

Mounted parallel with the hammer piston 1 and linked thereto by a saddle 8 are two lift pistons 9,9, each mounted for reciprocation within a separate hydraulic cylinder 10. The cylinders 10 are welded to the base 3.

The base 3 serves as an anvil for transmitting the hammer blows to the pile 4. Thus when the piston 1 is raised a desired height by the hydraulic cylinders 10 and lift pistons 9 and then allowed to fall, the piston head 5 strikes the hydraulic oil 7, which in turn transmits a cushioned blow to the base 3 and the pile 4.

Located in the space between the piston head 5 and the base 3 is a fluid-pressure-responsive switch 11 which, when the pressure of the oil 7 increases in response to the impact of the piston head 5, sends an electrical pulse via a line 12 to a control box 13 and associated hydraulic pump 15. The pulse is briefly delayed (a fraction of a second) by an electrical delay device 16 so that the pile-driving force of the impact is fully used before the pump 15 is allowed to lift the piston. When the control box 13 receives the delayed impulse from the switch 11 it operates a solenoid-controlled valve 17 and diverts hydraulic fluid being pumped by the hydraulic pump 13 into hydraulic lines 14 to the cylinders 10, thereby lifting the pistons 9 and in turn the hammer piston 1. The length of time for which the fluid is fed to the cylinders 10, and therefore the height to which the piston 1 is lifted, is pre-set by the setting of a variable timer 18 by the hammer operator.

The control box includes provision for switching from the automatic mode, in which the lifting of the piston 1 is initiated by a pulse from the switch 11, to a manual control mode, in particular to allow for first lifting of the piston at start-up of the hammer.

The illustrated device has proved in experimental operation to be very effective in providing percussive blows at a frequency as high as 45 to 80 per minute, with a lifting time varying from a fraction of a second to a little more than a second, in which time the hammer was raised up to about one meter from its impact position.

We claim:

1. A method of driving a pile into the ground, comprising disposing said pile uprightly upon or at least partly within the ground with an upper end of the pile projecting out of the ground, confining a quantity of a hydraulic fluid in a chamber which is in direct or indirect impact-transmitting contact with the upper end of said pile, striking the upper surface of said hydraulic fluid by allowing a substantial weight to drop thereon, detecting a resulting increase in the pressure of said hydraulic fluid and automatically lifting said weight to a desired height in response to the detection of said resulting pressure increase, and automatically allowing the weight to drop.

2. The method of claim 1 wherein percussive blows are automatically provided to the pile at a predetermined frequency.

3. A hammer for driving piles into the ground, comprising a cylindrical barrel having a solid base, a hammer piston mounted for sliding reciprocal movement towards and away from said solid base, a space within said barrel between said hammer piston and said base wherein a quantity of fluid is confined, a pressure switch adapted and disposed to produce an elecctrical signal in response to an increase in fluid pressure in said space within the barrel between said hammer piston and said base, lift means to lift said hammer piston away from said base and comprising at least one piston and hydraulic cylinder linked to said hammer piston and working in parallel alignment with it, means to initiate operation of said lift means in response to a said electrical signal, valve means to release hydraulic pressure from said hydraulic cylinder, and a timer to operate said valve means a predetermined time after operation of said lift means is initiated to automatically provide percussive blows by said hammer piston at a predetermined frequency.

4. A piling hammer according to claim 3, wherein said hydraulic lift means comprises at least one piston and associated hydraulic cylinder, said piston and cylinder being directly mechanically linked to the piston which is within said barrel and operating substantially in parallel alignment with it.

5. A piling hammer according to claim 4, having a valve to quickly release pressure from said hydraulic cylinder.

6. A piling hammer according to claim 5, further having means to vary the distance through which the piston is lifted by said lift means.

7. A piling hammer according to claim 6, wherein said means to vary the distance through which the piston is lifted is a variable timer.

8. A piling hammer comprising a cylindrical barrel, an anvil sealed to an end of said cylindrical barrel, a piston mounted for sliding linear reciprocal movement within said barrel, a space between said piston and said anvil wherein a quantity of fluid is confined, a fluid-pressure-responsive switch in communication with the space between said piston and said anvil and adapted to produce an electrical signal in response to an increase in fluid pressure within said space when said piston impacts the fluid in said space, and hydraulic lift means arranged to automatically lift said piston in a direction away from said anvil upon receipt of said electrical signal, the lifting of said piston being initiated by the electrical signal.

* * * * *